United States Patent [19]

Hintze

[11] 4,152,956

[45] May 8, 1979

[54] COMPRESSOR FOR AIR-CONDITIONING DEVICES FOR VEHICLES

[76] Inventor: Rudolf Hintze, Lessingstr. 32, 6056 Heusenstamm, Fed. Rep. of Germany

[21] Appl. No.: 823,003

[22] Filed: Aug. 8, 1977

[30] Foreign Application Priority Data

Aug. 24, 1976 [DE] Fed. Rep. of Germany ..... 2638001

[51] Int. Cl.[2] ..... F16F 15/32

[52] U.S. Cl. ..... 74/603; 417/419

[58] Field of Search ..... 74/603, 595, 600; 417/419

[56] References Cited

U.S. PATENT DOCUMENTS

| | | | |
|---|---|---|---|
| 840,190 | 1/1907 | Anderson | 74/595 X |
| 3,112,658 | 12/1963 | Berlyn | 74/603 |
| 3,258,992 | 7/1966 | Hittell | 74/603 |
| 3,259,307 | 7/1966 | Ayling | 417/419 X |
| 3,465,954 | 9/1969 | Ellis | 417/419 X |
| 3,513,721 | 5/1970 | Valbsorn et al. | 74/603 |

*Primary Examiner*—Leonard H. Gerin
*Attorney, Agent, or Firm*—Michael J. Striker

[57] ABSTRACT

An improved vehicle driven air conditioning compressor having a rotatable crankshaft and eccentric reciprocating pistons in which there is provided a spring system connected to the eccentric in such a manner that peak valves of torque during compression are minimized.

12 Claims, 6 Drawing Figures

COMPRESSOR FOR AIR-CONDITIONING DEVICES FOR VEHICLES

Figure 4:
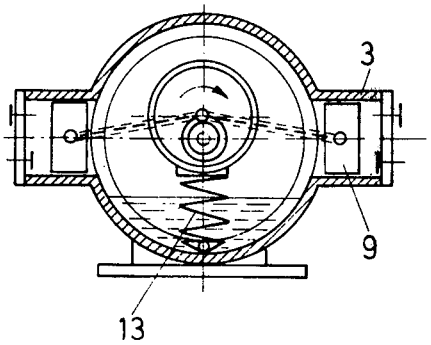

The invention relates to a compressor associated to an air-conditioning device suctioning in its vaporizer the cooling gas and supplying the same condensed to the densification pressure, whereafter the cooling means is guided back via a stress relieving valve into the vaporizer. The novelty resides in the provision of means diminishing and distributing the torque moment peaks conditioned by the condensator pressure to be overcome.

Because of the cost involved, this type of compressor are usually provided with as few cylinders as possible. However, a one-cylinder construction, so far as the stroke volume is concerned that determines the cooling effect, is limited by the factual circumstance that the torque moment peak conditioned by the densification terminal pressure extremely encumbers the drive means of the compressor. This drive means itself is driven to rotate by the vehicle engine via a belt and an electromagnetic coupling and needs to be the stronger and more expensively built-up, the higher the torque peak required from the compressor and also the force necessary for overcoming this peak. The high liquefaction pressure corresponding to high outer temperatures can cause slipping of the drive means and provoke the therefrom possibly resulting dangers, such as burning of the belt and the consequences thereof.

For these very reasons and also in order to ensure the stroke volume of the compressor required for en efficient cooling of the vehicle interior, such compressors used to be equipped with two, or a plurality of, cylinders. This quite naturally involves higher manufacturing costs, as well as higher friction losses, and this finds expression in a higher force such compressors need to be driven by.

These plural cylinder compressors, in dependence on the number of the cylinders they include, distribute the torque moment. In a one-cylinder of the same volume, the efficiency of the torque moment lasts across the crankshaft angle of 45°. Consequently, where for instance a five-cylinder is in question, each of the five peaks will amount to a 9° angle. Such shorter peak ranges may be overcome more easily at a given gyration. Herein, the torque moment peaks to be dealt with remain unchanged, and, in effect thereof, no alteration is met in the impact they have onto the belt drive and the electromatic coupling.

Now, the object of this invention is to provide a distribution of the encumbering affecting the driving means and a simultaneous lowering of the load peaks. For instance, one half of the densification terminal pressure gets here stored, when the driving means are just lightly burdened during the suction phase of, and/or during the incipient densification carried out by, the compressor. This storing is effectuated by a springing force store which then discharges its energy during the densification stage for coacting therein. In this way, the revolution moment requirable for overcoming the torque moment peaks is approximately halved.

The here described invention deviates from the traditional multi-cylinder constructions of such compressors. Herein, the high torque moment peaks remain unchanged and only the crankshaft angle which the driving means has to deal with becomes decreased in effect of a greater number of such peaks distributed around the crankshaft circle. Within the purview of this invention, such peaks are not only sectioned, but also their height is diminished and the loading of the driving means is thereby lessened.

Accordingly, the operation of for instance a two-cylinder burdening the driving means is influenced by the storing provided for by the invention and the torque moment gets reduced to about one half of that required by a usual four-cylinder for overcoming the there existing densification terminal pressure. In effect thereof, the respective driving means can be less powerful and the thus achieved regular load results in a quieter run.

The partial storing of the torque moment as provided by this invention for overcoming the densification terminal pressure is particularly advantageous in case of a double-stroke one-cylinder that comparatively the lowest friction loss and can be made at lowest possible costs, and which also has the most suitable run behavior corresponding to that of a four-cylinder having to work against a low densification pressure.

The springing pressure store can take on the storage in the amount only of a set value corresponding to the expected torque moment peaks. This amount should be preferably within the range of higher pressures and, being so, can, in more expensive store construction, adjust the respective stored value precisely to the densification pressure. The finely setup springing pressure store is here replaced by a pressure extendable body exposed to the densification pressure, which body allows to adjust the height of the pressure force to be stored to the existing densification pressure.

Figure 5:
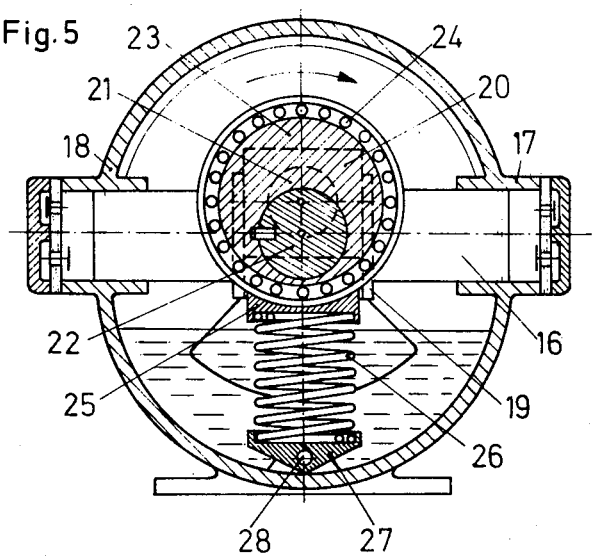
Figure 6:
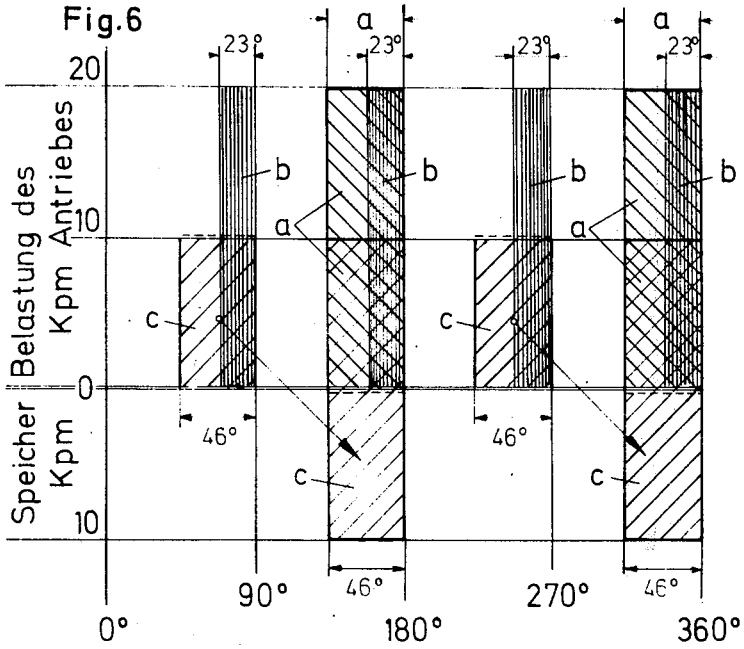

The invention will be explained in more detail hereinafter with regard to the embodiments illustrated in the drawings:

FIGS. 1, 2, 3 and 4 show a two-cylinder compressor in its various positions, while FIG. 5 displays a double-piston compressor with a crankshaft guide, and FIG. 6 depicts in a table the distribution of the torque moments in different compressor constructions.

In FIGS. 1 to 4, 1 stands for a crankshaft housing and 2 and 3 designate the oppositely positioned cylinders. In the middle of the housing, the crankshaft 4 is located having a crankshaft pin 5, where are attached both the connecting rods 7 driving the pistons 8 and 9. On the axle of the crankshaft pin, an eccenter 10 is provided, rotatable therewith and carrying in a rotary relationship thereto a ring 11, that in its turn bears a spring fixation carrier 12, supporting one side of a spring 13, whose other side is attached to a footing holder 14 arranged pivotally on a swivel 15.

Figure 1:
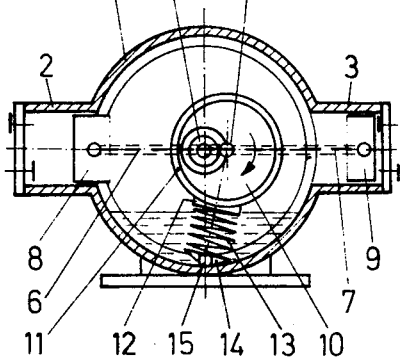

The spring 13 is configured as a pull and pressure spring. Same is shown in FIG. 1 in its neutral relieved length wherein it counteracts against any change in its said neutral length with a predetermined resistance, corresponding as the stored springing force to a value which the construction projection assumed as expectable in the terminal positions. This value is equally great in case of compression and extension of the spring 13.

Figure 2:
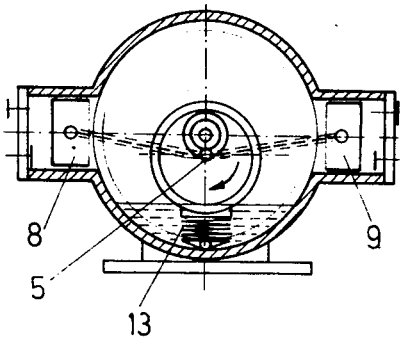

When the crankshaft 4, its pin 5 and the eccenter 10 rotate to the right in the direction of the indicated arrow, the spring 13 becomes compressed, as FIG. 2 shows. In effect of this motion, the piston 9 is shifted to a half-suction phase, while, at the same time, the piston 8 has begun the preliminary densification. Both these actions require just a small force input, so that there is possible a simultaneous compression of the spring 13 into one of its storing positions. In the storing position visible in FIG. 2, the spring 13 helpfully coacts in the continuing revolution of the crankshaft in the clockwise direction, wherein the crankshaft pin 5 participates, until expulsion occurs of the gas condensed to its liquifaction pressure and the suction stroke contemporaneously comes to its end. This terminal position is recognizable from FIG. 3, where the storing spring 13 is in its neutral length again.

Figure 3:
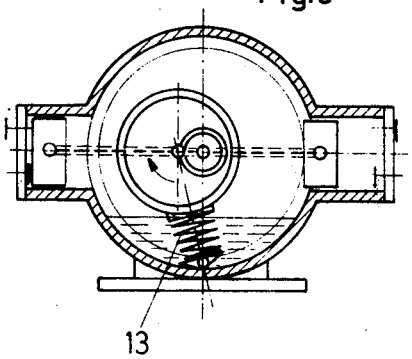

Now, when the crankshaft continues revolving, together with the eccenter and the crankshaft pin fixed on a common axle, the spring 13 extends from its neutral condition apparent from FIG. 3 into that of FIG. 4. Thus, this spring, endowed with the force stored in this way, is enabled to coact again and help the piston 9 to achieve condensation in its cylinder 3, in the same way as this spring, having been put under pressure, coacted in the case represented in FIG. 3. In effect hereof, a position is reached that is identical with that shown in FIG. 1, wherein the spring 13 is anew in its neutral length and cannot exert either a pressure or a pulling force.

FIG. 5 is illustrative of a double-piston compressor operating according to the same principle and being driven by the crankshaft guide. The housing and the cylinder are arranged similarly as those visible in FIGS. 1 to 4. However, there is provided herein one sole piston 16 only, reciprocable in two mutually opposite half-cylinders 17 and 18 and being driven in its central guide 19 by a sliding block 20 engaged in its bore by the crankshaft pin 21. Here, the eccenter 23 is fixed on the crankshaft and is arranged on a common axis with the crankshaft pin. This eccenter forms the inner race ring for a needle bearing 24, the outer race ring wherefor carries a spring footing holder 25 that has fixed thereto one end of a spring combination 23, whose other end is attached to a footing support 27, pivotable on an axle 28. In this construction, said spring combination 26 consists of a pair of springs of which one is pulling and the other one is of a pressing biasing nature, and the one of these springs is installed inside the other. In the neutral middle position, these springs act against one another, FIG. 5 shows their extended condition wherein they are capable of coacting in the densification occurring in the cylinder 17.

FIG. 6 illustrates in juxtapositions the various compressor constructions and the torque moment peaks needed for densification to the respective liquefaction pressure, which peaks are to be mastered by the driving means of the compressor. The ordinate depicts the torque moments whose number suitably correspond also to the respective liquefaction pressures. The abscissa shows the sub-division of the crankshaft circle into the crankshaft angles of interest.

In the case of parallel two-cylinders, as well as in that of double-stroke one-cylinder compressors, the one half-rotation of the crankshaft corresponds to one propulsion of the condensed gas, so that there are within the crankshaft circle rotation two propulsions within identical spacings of 180° angles. The torque moments require from the driving means in such a type of a double cylinder compressor are indicated in the Table under letter "a". The encumbering by 20 kpm occurring during the densification and expulsion extends over a crankshaft angle of assumably 46° in the case of either half-revolution. This crankshaft angle and therethrough also the loading of the driving means can be decreased in the way of, for instance, doubling the cylinder number, with preservation of the same summary stroke volume, to four. This naturally means that there are taken in account an increased friction and higher production costs. Such a diminishing of each cylinder volume to one half, being achieved by doubling of the cylinder number, is shown under letter "b".

In such four-cylinder, the absolute height of the incumbering remains unchanged; however, the here valid crankshaft angles are halved to 23° whereby there is alleviated the gyration moment exploited for overcoming the temporarily shortened peak values.

The solution envisaged by the present invention achieves the division of the peak loads into four crankshaft angles, each of which amounts to 46°, while at the same time the peak torque moment is halved, without increasing the number of cylinders. This peak torque moment even becomes reduced where a double-stroke one-cylinder is employed. Thereby, each second load peak results in an energy storage exploitable in each subsequent densification and expulsion stroke. These stored values designated in the Table by letter "c" enhance the working stroke by, for instance, one half, so that there is to be added thereto just the second half the energy for arriving at the final result corresponding to the value "a" obtainable from a normal double-cylinder.

From the viewpoint of the encumbering of the driving means, the invented two-cylinder works as a four-cylinder does and has to overcome just one half of the liquefaction pressure. As a matter of fact; this pressure does not experience any change, however, the driving means, namely the driving belt and the electromagnetic coupling, have to deal with just one half of the peak value of the torque moment that is required by a normal two-cylinder compressor having the same volume and the same liquefaction pressure.

The Table of FIG. 6 makes apparent the appearance of the storing values "c" reflected by the driving means encumbering as standing above the zero-line and how the storage value underneath this line reaches, in presence of now merely one half of the load on the driving means, a total value needed for the densification and expulsion that is identical with that of a normal compressor having the same stroke volume.

I claim:

1. An improved compressor in the circuit of an air-conditioning device for vehicles being driven by the vehicle engine, said compressor having a rotatable crankshaft, in which said improvement comprises means for storing the densification terminal pressure force; and means operative for utilizing said stored force for diminishing and distributing the torque moment peaks generated and for overcoming the torque moment during the densifying compaction.

2. The compressor of claim 1, wherein said storing precedes each rotational moment peak of the crankshaft during the densification and exhaustion cycle of the compressor.

3. The compressor of claim 1, wherein said storage and utilizing means are operative for reducing the load angle of the crankshaft, and reduce the force needed for overcoming the subsequent torque peak moment by about onehalf of its initial value.

4. The compressor of claim 1, wherein said storage means discharges the stored force during the second part of a two-part densification and exhaustion cycle of the compressor, thereby diminishing the torque moment needed to be provided by a drive for the compressor by the value of the stored force.

5. The compressor of claim 1, wherein said storage means is configured as a spring system.

6. A compressor as defined in claim 5, wherein said spring system includes a contraction spring and an expansion spring.

7. A compressor as defined in claim 6, wherein one of said springs is installed inside the other.

8. A compressor as defined in claim 6, wherein said springs counteract each other in a neutral middle position.

9. A compressor as defined in claim 1, wherein the storage and discharge of the force is effectuated by an eccenter affixed to said crankshaft.

10. A compressor as defined in claim 9, wherein said eccenter has a throw value corresponding to a preselected value of the force to be stored.

11. A compressor as defined in claim 1, wherein said storage means is a pressure extendable body exposed to the force of said densifying terminal pressure.

12. A compressor as defined in claim 11, wherein said body modulates the amount of force stored responsive to the cycle of said densification and exhaustion cycle.

* * * * *